US005123166A

United States Patent [19]

Kanemitsu et al.

[11] Patent Number: 5,123,166

[45] Date of Patent: Jun. 23, 1992

[54] EAR FORMING METHOD OF SHEET METAL MADE OF POLY-V PULLEYS

[75] Inventors: Toshiaki Kanemitsu, Kobe; Kazuyuki Oda, Kako, both of Japan

[73] Assignee: Kabushiki Kaisha Kanemitsu, Akashi, Japan

[21] Appl. No.: 646,730

[22] PCT Filed: Jul. 11, 1989

[86] PCT No.: PCT/JP89/00699

§ 371 Date: Feb. 5, 1991

§ 102(e) Date: Feb. 5, 1991

[87] PCT Pub. No.: WO91/00785

PCT Pub. Date: Jan. 24, 1991

[51] Int. Cl.[5] ..... B21K 1/42

[52] U.S. Cl. ..... 29/892.3; 72/110; 474/170

[58] Field of Search ..... 29/892.3, 892; 474/166, 474/168, 170, 174; 72/105-107, 110

[56] References Cited

U.S. PATENT DOCUMENTS 4,524,595 6/1985 Oda ..... 72/105
4,551,122 11/1985 Kraft et al. ..... 29/892.3

FOREIGN PATENT DOCUMENTS 190569 10/1984 Japan ..... 474/170
125457 7/1985 Japan ..... 474/170

*Primary Examiner*—P. W. Echols
*Attorney, Agent, or Firm*—Jones, Tullar & Cooper

[57] ABSTRACT

The invention relates to a sheet metal made poly-V pulley in which poly-V grooves (10) to be engaged with poly-V belt are formed in the outer circumference of peripheral wall (5) of a cup-shaped blank (3) integrally forming the peripheral wall (5) extending in the direction orthogonal to the bottom wall (6) at the end part of the bottom wall (6), and annular ears (7, 9) of single layer projecting outward in the radial direction for preventing dislocation of the poly-V belt are formed at both ends of the peripheral wall (5), wherein the end part inner surface side of the bottom wall (6) side of the peripheral wall (5) is bulged inward in the radial direction when forming the ears (7) or before forming the ears (7) to thicken the bottom wall side end part of the peripheral wall, and hence the wall thickness of the bottom wall (6) side end part of the peripheral wall (6) is maintained even when a thin cup-shaped blank (3) is used, so that the problems of the strength, material cost and weight increase may be solved.

2 Claims, 9 Drawing Sheets

Fig.K

EAR FORMING METHOD OF SHEET METAL MADE OF POLY-V PULLEYS

CROSS-REFERENCE TO RELATED APPLICATION

This application contains subject matter related to application Ser. No. 07/640,414, filed Jan. 28, 1991.

TECHNICAL FIELD

The present invention relates to a grooved poly-V made of sheet metal for engaging a poly-V belt, and more particularly to a grooved poly-V pulley made of sheet metal and including an annular single-layer ear projecting outward in the radial direction, at the end of the bottom wall side of the peripheral wall where poly-V grooves are formed for prevention dislocation of a poly-V belt.

BACKGROUND ART

A method of forming an annular single-layer ear projecting outward in the radial direction for prevention of dislocation of a poly-V belt at the end of the bottom wall side of the peripheral wall in which poly-V grooves are formed is disclosed in laid-open Japanese Patent Application No. 62-84845.

According to the disclosed method, a cup-shaped blank of sheet metal integrally forming a peripheral wall extending in a direction orthogonal to a bottom wall at an end part of the bottom wall is placed over a circular inner pattern tool for supporting its inner surface, and a V-shaped ear forming protrusion formed on a circular surface of a circular outer pattern tool so as to divide a root part of the peripheral wall into two sections. The peripheral wall corresponds to the thickness range of the bottom wall of the cup-shaped blank, and while rotating, the V-shaped ear forming protrusion is driven into the root part of the peripheral wall and an annular ear is formed projecting outward in the radial direction to prevent dislocation of a poly-V belt at the end of one side of the peripheral wall.

In this ear forming method, however, if the thickness of the bottom wall or peripheral wall is thin, that is, if the wall thickness of the cup-shaped blank is thin, the distance from the bottom of the V-shaped groove formed by driving the ear forming protrusion of the circular outer pattern tool into the root part of the peripheral wall, to the inner surface of the corner part where the peripheral wall and bottom wall intersect becomes extremely short, and this distance becomes even shorter in the subsequent poly-V groove forming step, that is, in the step of forming poly-V grooves in the peripheral wall. As a result, the desired strength cannot be achieved.

Therefore, this ear forming method is forced to use a sheet metal blank of greater thickness, resulting in higher material cost, and a significant increase in weight of the sheet metal made poly-V pulley.

In light of these problems, the present invention is intended to provide an ear forming method for sheet metal made poly-V pulleys, and the poly-V pulleys made therefrom, capable of solving the problems of high material cost and increased weight, while maintaining sufficient distance and strength.

SUMMARY OF THE INVENTION

To achieve the above object, the present invention provides a first ear forming method for poly-V pulleys made of sheet metal by placing a cup-shaped blank of sheet metal integrally forming a peripheral wall extending in a direction orthogonal to a bottom wall at the end part of the bottom wall, over a circular inner pattern tool for supporting its inner surface, driving a V-shaped ear forming protrusion formed on a circular surface of a circular outer pattern tool into the root part of the peripheral wall corresponding to the thickness range of the bottom wall of the cup-shaped blank, while rotating, so as to divide a root part of the peripheral wall into two sections at its outer side, and forming an annular ear projecting outward in the radial direction for preventing dislocation of a poly-V-belt, at the end part of one side of the peripheral wall in which poly-V grooves are formed.

An annular space is formed at least between the corner inner surface where the peripheral wall and bottom wall intersect and the circular inner pattern tool opposite to this corner inner surface, and the inner surface at the end of the bottom wall side of the peripheral wall bulges inward in the radial direction as a result of pressing the peripheral wall so as to fill up this space when forming the annular ear, thereby increasing the thickness at the end of the bottom wall side of the peripheral wall.

According to a second ear forming method for poly-V pulleys made of sheet metal, the cup-shaped blank of sheet metal is placed over a circular inner pattern tool having an annular space formed at least at the confronting position with the corner surface where the peripheral wall and the bottom wall of the blank intersect. The cup-shaped blank is pressed from the outer side so as to fill the space in the circular inner pattern tool to bulge the inner surface of the bottom wall side end part of the peripheral wall inward in the radial direction, thereby increasing the thickness of the bottom wall side end part of the peripheral wall. A V-shaped ear forming protrusion formed on a circular surface of the circular outer pattern tool so as to divide the root part of the peripheral wall into two sections from the outer side, is driven, while rotating, into the root part of the peripheral wall corresponding to a thickness range of the bottom wall of the thickened cup-shaped blank, and an annular ear projecting outward in the radial direction for preventing dislocation of a poly-V belt is formed at the end part of one side of the peripheral wall in which poly-V grooves are formed.

As the sheet metal made poly-V pulley according to the present invention, it is enough when the end part at the inner side of the bottom wall side of the peripheral wall where poly-V grooves are formed bulges inward in the radial direction and is formed with a great thickness.

Thus, according to the first and second ear forming methods for making poly-V pulleys of sheet metal and the resulting sheet metal made poly-V pulleys, even when a thin cup-shaped blank is used, the inner surface of the bottom wall side end part of the peripheral wall is bulged inward in the radial direction, and the bottom wall side end part of the peripheral wall is formed with a great thickness. Because of this great thickness, the strength of the pulley may be sufficiently satisfied, and, what is more, since at the end of the bottom wall side of the peripheral wall is partially increased in thickness, the material cost and weight are hardly changed. Hence, it is possible to have a sheet metal made poly-V pulley possessing a single-layer ear at the bottom wall side end part of the peripheral wall that is inexpensive, lightweight and free of strength problems.

BRIEF DESCRIPTION OF THE DRAWINGS

FIG. 1K and FIG. 1L are sectional views showing the cup-shaped blank in FIG. 1E formed according to the second ear forming method of the present invention.

DESCRIPTION OF THE PREFERRED EMBODIMENTS

(1) Peripheral End Folding Step

Figure 1A:
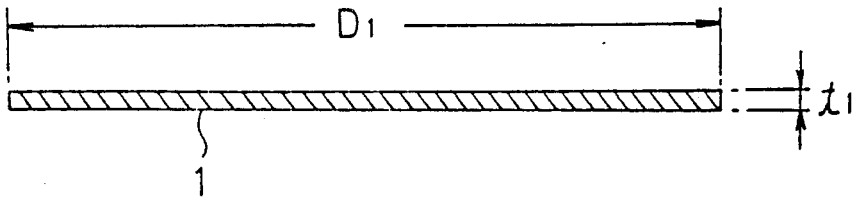
FIG. 1A is a sectional view showing a sheet metal blank formed in a circular form.
Figure 1B:
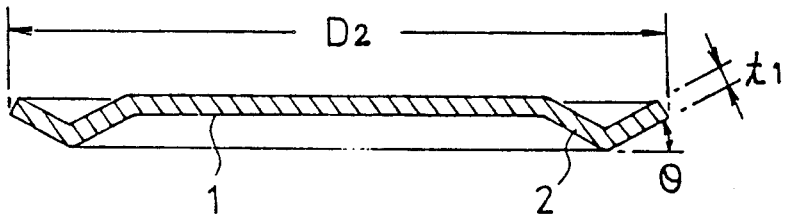
FIG. 1B is a sectional view showing a folded state of the peripheral end part of the sheet metal blank shown in FIG. 1A in a V-shape.
Figure 1C:
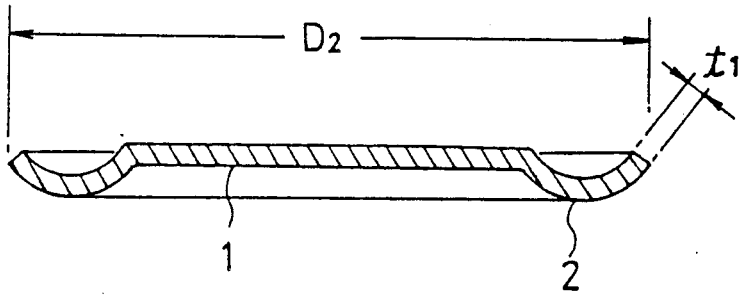
FIG. 1C is a sectional view showing a folded state of the peripheral end part of the sheet metal blank shown in FIG. 1A in a different shape from the V-shape shown in FIG. 1B.

In this step, a metal disc-shaped flat sheet blank (hereinafter called sheet) 1 shown in FIG. 1A is pressed, and peripheral ends 2 are folded in a concave or convex form in a specified width range as shown in FIG. 1B or FIG. 1C. The method of folding may result in either a V-form as shown in FIG. 1B or a U-form as shown in FIG. 1C, or it may result in an undulated or corrugated form (not shown in the drawing). In this peripheral end folding step, the initial diameter D1 of the 1 sheet becomes slightly shorter to D2. For example, the sheet 1 with D1=138 mm becomes a sheet 1 with D2=133.9 mm. The thickness t1 of the sheet 1 is unchanged, and if changed, the extent of the change is insignificant. This step is executed as a pretreatment for the peripheral end thickening step.

(2) Peripheral End Thickening Step

Figure 1D:
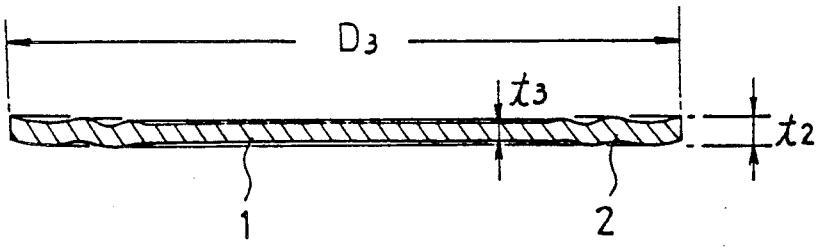
FIG. 1D is a sectional view showing a thickening state of the peripheral end part of the sheet metal blank shown in FIG. 1A formed by pressing the sheet metal blank shown in FIG. 1B or FIG. 1C.
Figure 2:
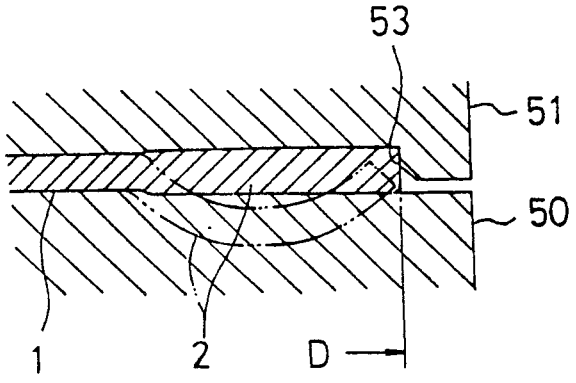
FIG. 2 is a sectional view which is used to explain the thickening method of the folded peripheral end part of the sheet metal blank used in the present invention.

In this step, the thickness of the peripheral ends 2 is increased by flattening the peripheral ends 2 of the sheet 1 of FIG. 1B or FIG. 1C. This step is achieved by pressing the sheet 1 by means of a bottom pattern tool 50 and a top pattern tool 51 as shown in FIG. 2. To carry out this step, the edges of the sheet 1 are held so that the diameter D3 of the sheet 1 is achieved which is smaller than the diameter D1 of the sheet 1 shown in FIG. 1A. It is, however, not required that the diameter D3 of the sheet 1 be smaller than the diameter D2 of the sheet 1 shown in FIG. 1B or FIG. 1C. Therefore, this step is usually carried out by holding the sheet 1 so that the diameter D3 of the sheet 1 after this step may be equal to the diameter D2 of the sheet 1 shown in FIG. 1B or FIG. 1C, or by holding the edges of the sheet 1 so that it may be slightly larger than the diameter D2. For achieving the dimensional relationship of the diameters D1, D2, D3, a step 53, shown in FIG. 2 is provided in the top pattern tool 50 or bottom pattern tool 52 for restricting the limitless diameter extent, and the inside diameter D of the step 53 is set in a range of $D1>D\geqq D2$. The diameter D3 of the sheet 1 after this step is equal to or nearly equal to D, and for example when the angle $\Theta$ of the peripheral ends 2 of the sheet 1 shown in FIG. 1B is set at 35 degrees, D3 is 134.7 mm. Usually, after this step, the peripheral ends 2 of the sheet 1 are roughly flattened, but to be precise, as shown in FIG. 1D, the surface is visibly corrugated. In this case, the corrugated shape is flattened to an invisible level in the subsequent cup-shape blank forming step. But, of course, the peripheral ends 2 may be flattened to such an extent that the corrugated surface may not be visible in this step.

The peripheral ends 2 of the sheet 1 are increased in thickness in this step, but the thickened portion may also include areas other than the peripheral ends 2. For example, when the peripheral ends 2 are corrugated as shown in FIG. 1D and the initial thickness t1 of the peripheral ends 2 is 2.6 mm, the thickness of the parts of the peripheral ends 2 of the sheet 1 after this step is 2.75 mm in the thinnest part, and 2.8 to 2.85 mm in the thickest part.

(3) Cup-Shaped Blank Forming Step

Figure 1E:
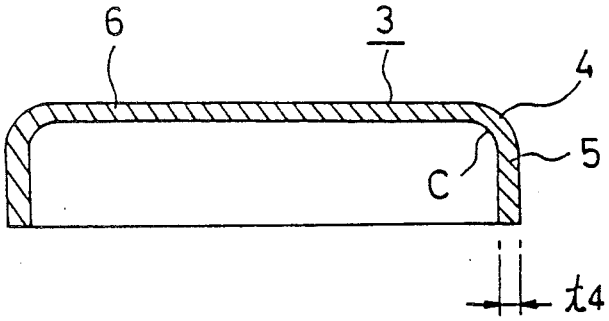
FIG. 1E is a sectional view showing the sheet metal blank shown in FIG. 1D after drawing so that the thickened peripheral end part may be a peripheral wall, and forming into a cup-shaped blank.
Figure 1F:
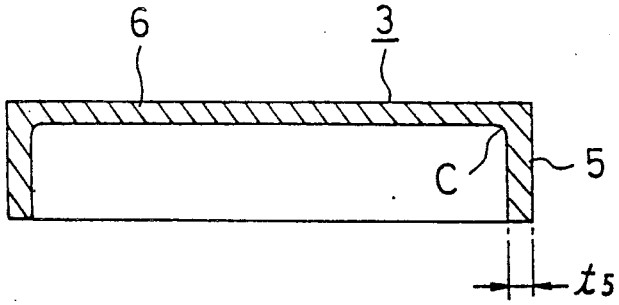
FIG. 1F is a sectional view showing the corner outer surface of the cup-shaped blank in FIG. 1E formed in a right-angle or similar shape.
Figure 1G:
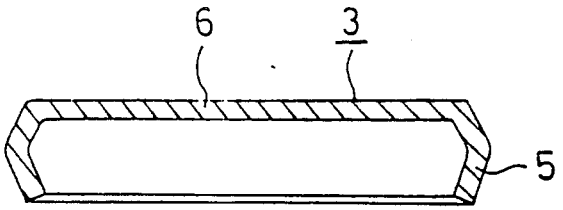
FIG. 1G and FIG. 1H show the peripheral wall of the cup-shaped blank in FIG. 1E with further thickened walls as required.
Figure 1H:
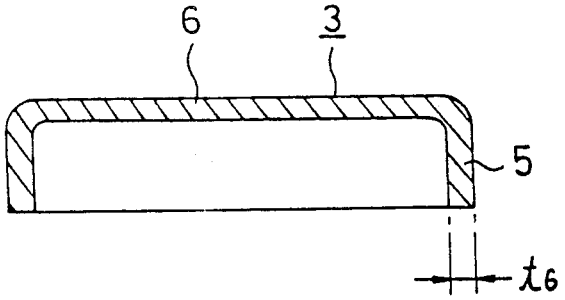
Figure 1I:
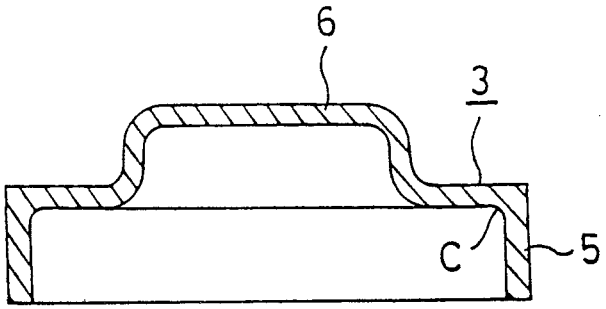
FIG. 1I is a sectional view showing a different shape of the cup-shaped blank.
Figure 1J:
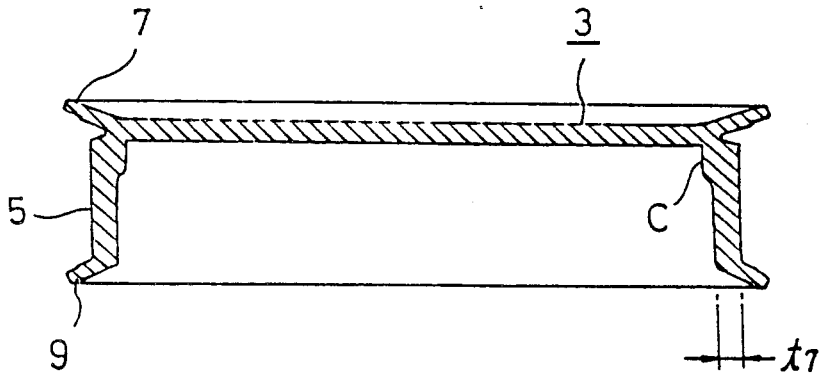
FIG. 1J is a sectional view showing the cup-shaped blank in FIG. 1F formed according to the first ear forming method of the present invention.
Figure 1J:
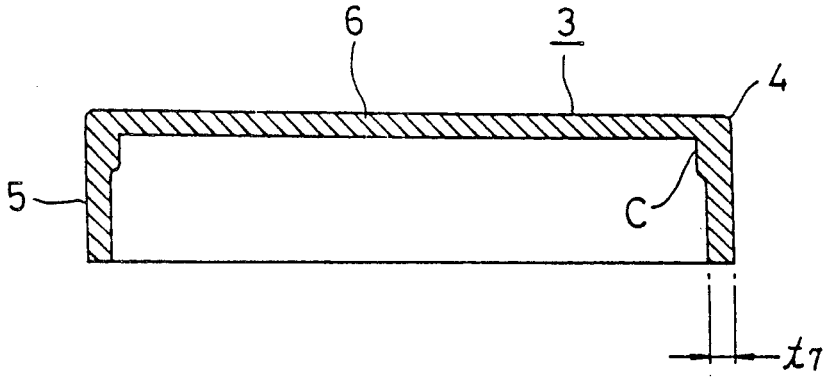

This is a step of making a cup-shaped blank 3 as shown in FIG. 1E or 1I by bending the thickened peripheral ends 2 of the sheet 1 in one direction. The cup-shaped blank 3 fabricated in this step possesses a peripheral wall 5 and a bottom wall 6, and the bottom wall 6 may be either flat as shown in FIG. 1E or bulged out in the middle as shown in FIG. 1I, or although not shown in the drawings, the middle part may be indented or the bottom may be indented like a flat bowl.

This step may also comprise a bending step for drawing and folding the thickened peripheral ends 2 of the sheet 1 as shown in FIG. 1E, and a corner forming step for forming the curved outer circumference of the corner 4 at the crossing point of the peripheral wall and bottom wall of the cup-shaped blank 3 after the bending step, in a right-angle or nearly right-angle shape, in forming a single layer ear.

Figure 3:
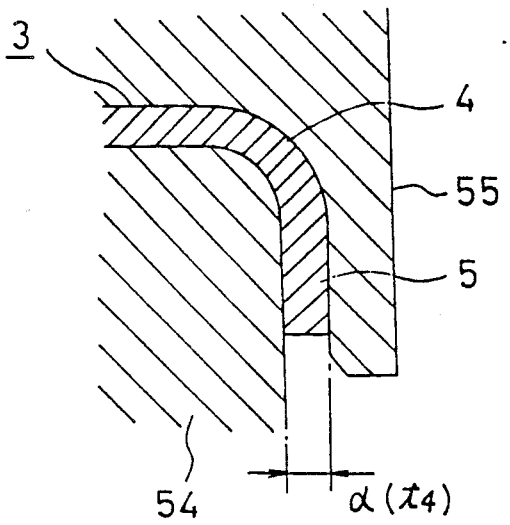
FIG. 3 is a sectional view which is used to explain the method of forming a disc-shaped sheet metal blank thickened in the peripheral end part into a cup-shaped blank.

In this case, bending by the drawing step is preferably executed by folding the peripheral ends 2 (see FIG. 1D) in one direction while holding the sheet 1 in FIG. 1D between the bottom pattern tool 54 and the top pattern tool 55 as shown in FIG. 3. At this time, by setting the gap between the bottom pattern tool 54 and the top pattern tool 55 slightly wider than the dimension of the wall thickness t2 of the peripheral ends 2 thickened in the peripheral end thickening step, the thickness t4 of the peripheral wall 5 of the resulting cup-shaped blank 3 is slightly greater than the thickness t2, so that the peripheral wall 5 is increased in thickness. For example, if the initial wall thickness t2 is 2.75 to 2.85 mm as shown above, the thickness t4 of the peripheral wall 5 of the cup-shaped blank fabricated in this bending step is 2.75 to 2.8 mm in the thinnest part, and 2.9 to 3.9 mm in the thickest part.

At the end of the peripheral end thickening step, if the peripheral ends 2 of the sheet are visibly corrugated, the surface may be corrected in this step so that the corrugation may not be visible, but it is not absolutely necessary, and it may be corrected gradually in this bending step and the subsequent corner forming step.

Figure 4:
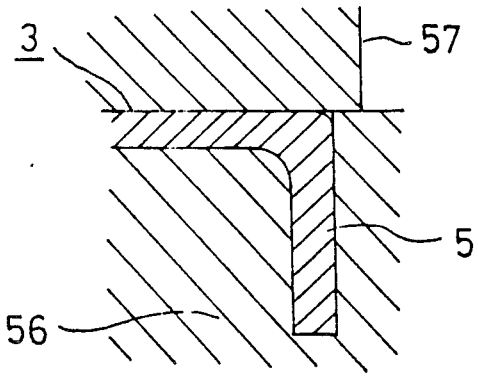
FIG. 4 is a sectional view which is used to explain the method of forming the corner outer surface of the cup-shaped blank into a right-angle or similar shape.

The corner forming step is preferably executed by holding the cup-shaped blank 3 after the bending step between the bottom pattern tool 56 and the top pattern tool 57 as shown in FIG. 4. At this time, the lower end of the peripheral wall 5 is defined by the bottom pattern tool 56. Thus, the thickness t5 of the peripheral wall 5 of the cup-shaped blank 5 is equal to or slightly greater than the thickness t4, and, at the same time, the corrugation of the peripheral wall 2 obvious at the end of the bending step is corrected to a high degree, and the thickness t5 becomes uniform at all parts. For example, when the cup-shaped blank 3, after the bending step is processed in the corner forming step, the thickness t5 of the peripheral wall 2 is 3.0 mm in all parts.

(4) Ear Forming Step

This is a characteristic step of the invention, in which the inner corner surface C at the intersection of the bottom wall 6 and the peripheral wall 5 of the cup-shaped blank is formed after the cup-shaped blank forming step is bulged, and single-layer annular ears 7, 9 are formed at both ends of the peripheral wall 5.

Figure 5A:
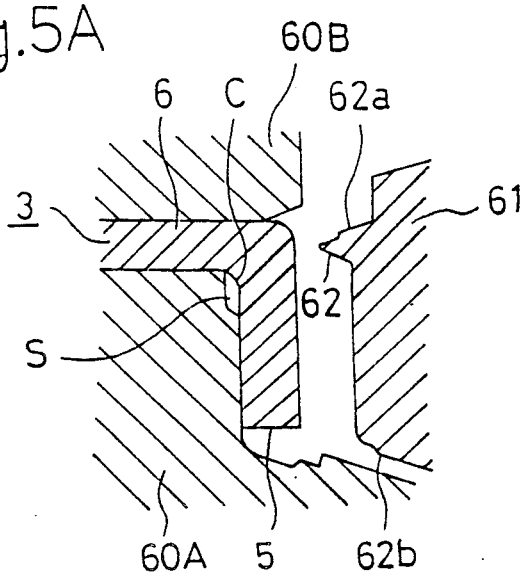
FIG. 5A to FIG. 5C are sectional views which are used to explain the method of forming single-layer annular ears at both ends of the peripheral wall while bulging the corner inner surface where the bottom wall and peripheral wall intersect.

Forming of the ear at one end of the bottom wall side 6 of the peripheral wall 5, that is, the first ear 7, and bulging of the corner inner surface C are effected as follows. As shown in FIG. 5A, the cup-shaped blank 3 is put on a circular inner pattern tool 60A having an annular space S at least at the position confronting the inner corner surface C (in the shown example, an annular space S extending not only at the confronting position with the corner inner surface C but also along the peripheral wall 5 for a long distance is formed in the circular inner pattern tool 60A), and the bottom wall 6 of the cup-shaped blank 3 is held between the circular inner pattern tool 60A and the circular upper pattern tool 60B, and the cup-shaped blank 3 is rotated by rotation of the circular inner pattern tool 60A and the circular upper pattern tool 60B.

At the root part of the peripheral wall 5 corresponding to the thickness range of the peripheral wall of the rotated cup-shaped blank 3, a V-shaped ear forming protrusion 62 formed on a circular surface of the circular outer pattern tool 61 so as to divide the root part of the peripheral wall 5 into two sections from the outside, is pressed against, and is driven into while rotating the ear forming protrusion 62, the blank 3 thereby forming the annular first ear 7. The ear 7 projects outward in the radial direction at one end of the peripheral wall 5 in which poly-V grooves are formed and prevents dislocation of a poly-V belt. At the same time, the peripheral wall 5 is pressed simultaneously to fill the space S by the pressure (holding pressure) of the circular outer pattern tool 61 and circular inner pattern tool 60A to bulge the bottom wall side end inner surface of the peripheral wall 5 inward in the radial direction, thereby thickening the bottom wall side end part of the peripheral wall.

As a result, the distance between the bottom of the V-shaped groove formed by driving the ear forming protrusion 62 of the circular outer pattern tool 61 and the corner inner surface C at the intersection of the peripheral wall 5 and bottom wall 6 may be kept long, and the strength requirement may be sufficiently satisfied if a thin cup-shaped blank is used.

Figure 5B:
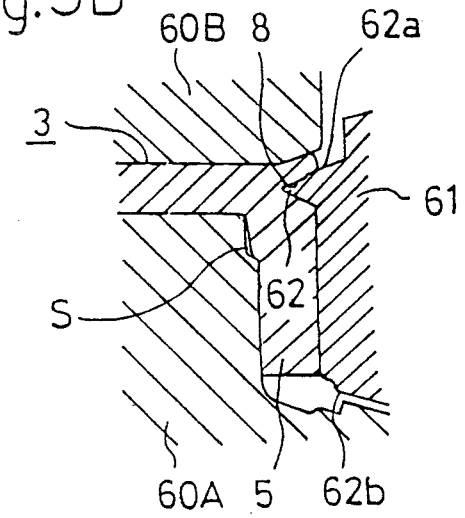
Figure 5C:
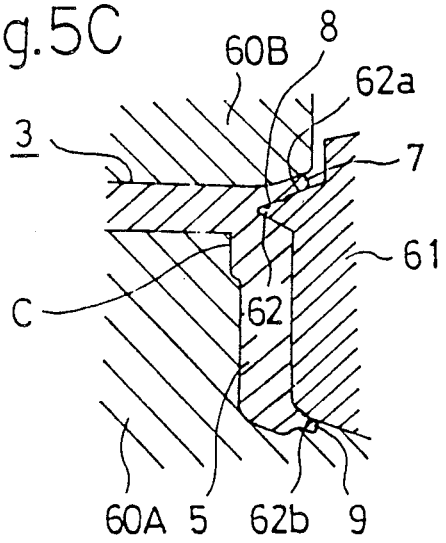

The second ear 9 is formed in the following manner. As shown in FIG. 5C, the cup-shaped blank 3 is placed on the circular inner pattern tool 60A, the peripheral wall 5 of the cup-shaped blank 3 is pressed by the circular outer pattern tool 61 during rotation and the steps shown in FIGS. 5A and 5B, and the outer edge of the peripheral wall 5 is extended outwardly of the peripheral wall 5, thereby forming the second ear 9. The second ear 9 is formed in this matter because a material flow occurs when the peripheral wall 5 is pressed by the circular inner pattern tool 60A and the circular outer pattern tool 61, and this material flow stretches the outer edge.

Forming of the first ear 7 and forming of the second ear 9 including bulging of the corner inner surface may be done simultaneously by using common pattern tools, or separately by using individual pattern tools. They may be formed either by one operation or by plural operations.

The first ear 7 and second ear 9 thus formed are composed of one layer.

The V-grooves 8 formed in this step function as the grooves for fitting the edge of the poly-V belt, together with poly-V grooves 10 mentioned below. It is preferable to form a relief part in the first ear 7 to avoid friction against the poly-V belt. This relief part may be easily formed by forming, for example as shown in FIG. 5A, a bulging part 62*a* outside of the ear forming protrusion 62. Similarly, by forming a bulging part 62*b* at the lower side of the circular outer pattern tool 61, a relief part not contacting with the poly-V belt may be easily formed in the second ear 9, as well.

(5) Poly-V Groove Forming Step

This is a step for forming a poly-V groove 10 on the outer surface of the peripheral wall 5 of the cup-shaped blank 3.

Figure 7:
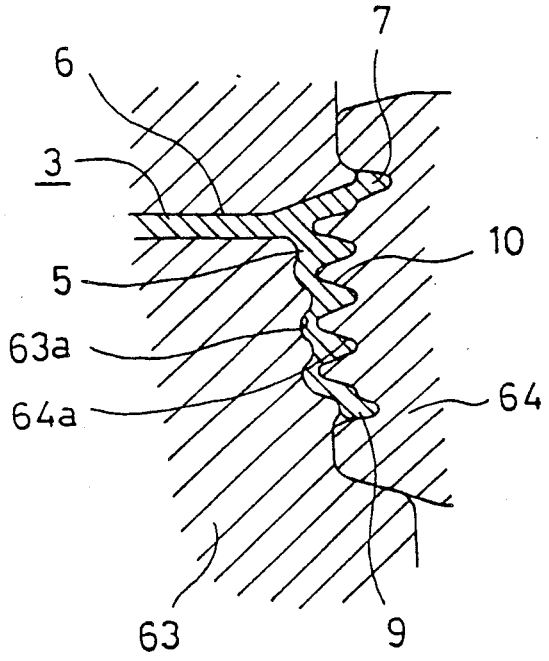
FIG. 7 is a sectional view which are used to explain the method of forming poly-V grooves in the peripheral wall of the sheet metal blank.
Figure 8:
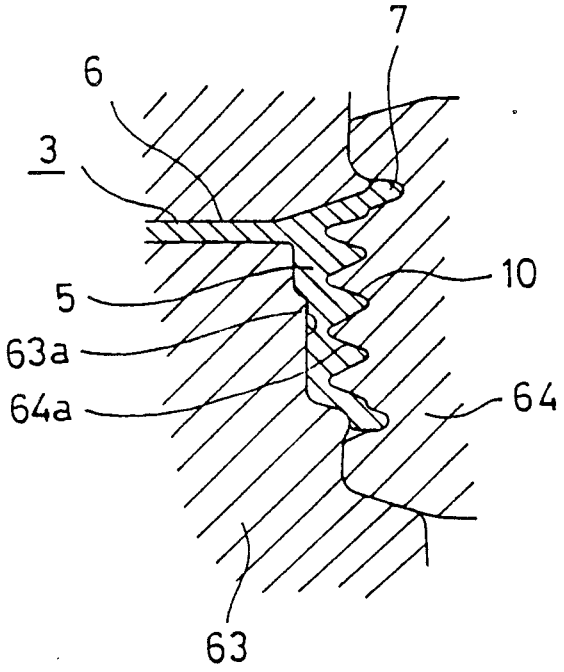
FIG. 8 is a sectional view which are used to explain the method of forming poly-V grooves in the peripheral wall of the sheet metal wall according to another forming method.

This step is achieved by forming poly-V groove 10 composed of plural V-groove groups in the peripheral wall 5 while holding the cup-shaped blank 3 between the circular inner pattern tool 63 and the circular outer pattern tool 64 as shown in FIG. 7 or FIG. 8. Instead of forming the poly-V groove 10 by one rolling process, it is preferable to form it by rolling processes, comprising a preliminary poly-V groove forming step, and a finishing step for further forming the poly-V groove of the cup-shaped blank 3 after the preliminary poly-V groove forming step and finishing the depth and pitch as demanded.

This step may be performed either as shown in FIG. 7, in which a forming plane 63*a* of the circular inner pattern tool 63 and a forming plane 64*a* of the circular outer pattern tool 64 alternately possess a bottom and peak, respectively and are formed to be engaged with each other, or as shown in FIG. 8, in which a forming plane 63*b* of the circular inner pattern tool 63 is flat in the vertical direction, and a forming plane 64*a* of the circular outer pattern tool 64 is formed in an undulated surface having a bottom and peak alternately. According to the method shown in FIG. 7, and as shown in FIG. 1M, a poly-V pulley 12 made of sheet metal possessing a poly-V groove 10 on the outer surface and having a shell part 11 undulated on the inner surface is fabricated. According to the method shown in FIG. 8, and as shown in FIG. 1N, a poly-V pulley 12 made of sheet metal possessing a poly-V groove 10 on the outer surface and having a shell part 11 being straight inside in the vertical direction is fabricated.

In the foregoing embodiment, when forming the annular first ear 7, the end part inner surface at the side of the bottom wall 6 of the peripheral wall 5 is bulged inward in the radial direction to thicken the bottom wall 6 side end part of the peripheral wall 5, but instead of this method, the following method is also possible.

The cup-shaped blank 3 in FIG. 1E is put on a circular inner pattern tool having at least an annular space formed at the confronting position with the corner surface C where the peripheral wall 5 and the bottom wall 6 intersect (such as the circular inner pattern tool 60A as shown in FIG. 5A), and the cup-shaped blank 3 is pressed from the outside by a circular outer pattern tool so as to fill up the space in the circular inner pattern tool, and the bottom wall 6 side end part inner surface of the peripheral wall 5 is bulged inward in the radial direction as shown in FIG. 1K to thicken the bottom wall 6 side end part of the peripheral wall 5, while the corner outer surface 4 of the cup-shaped blank 4 is formed in a right-angle or nearly right-angle shape.

Figure 1L:
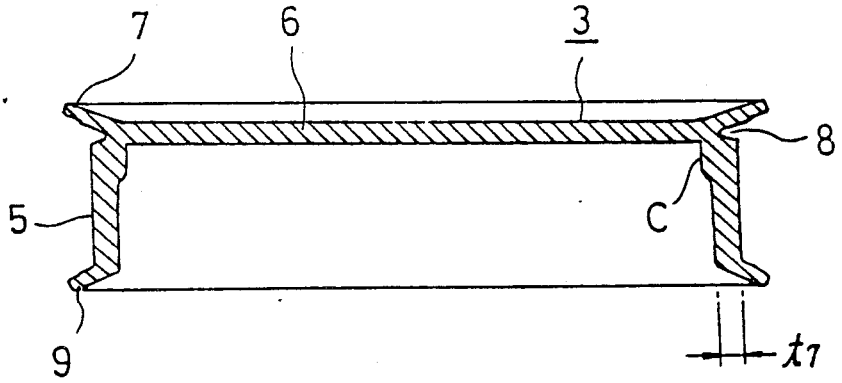
Figure 1M:
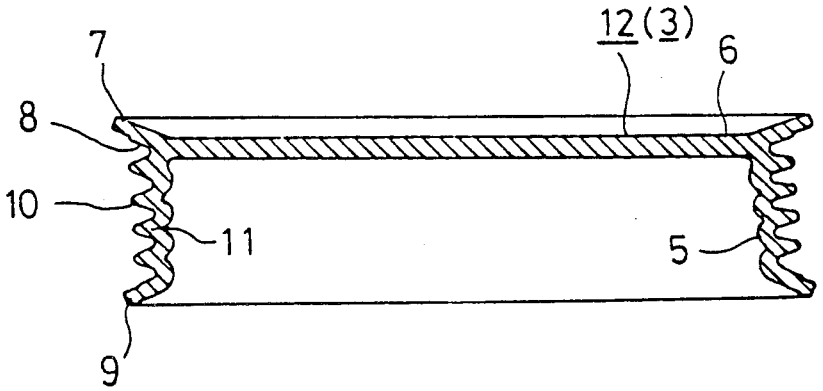
FIG. 1M is a sectional view showing poly-V grooves formed in the outer surface of the peripheral wall.
Figure 1N:
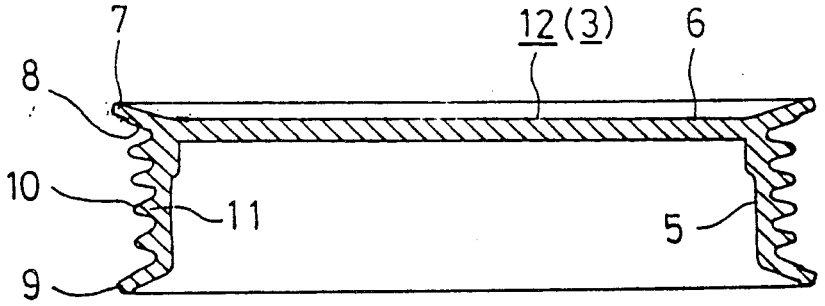
FIG. 1N is a sectional view showing poly-V grooves formed in the outer surface of the peripheral wall by a different forming method.

Afterwards, at the root part of the peripheral part 5 corresponding to the thickness range of the bottom wall 6 of the thickened cup-shaped blank 3, the root part of the peripheral wall is driven while rotating to divide into two sections from the outside by using the ear forming protrusion 62 of the circular outer pattern tool 61 as shown in FIG. 5A, and the annular first ear 7 projecting outward in the radial direction is formed at one end of the peripheral wall 5 in which poly-V grooves are formed, as also shown in FIG. 1L.

In this method, too, the second ear 9 may be formed either simultaneously with the first ear 7, as in the foregoing embodiment, or separately from the first ear 7.

Also according to this method, it is possible to keep a long distance from the bottom of the V-shaped groove formed by driving the ear forming protrusion 62 of the circular outer pattern 61, to the corner inner surface C at the intersection of the peripheral wall 5 and bottom wall 6, so that the desired strength may be sufficiently satisfied even if a thin cup-shaped blank 3 is used.

Besides, between the cup-shaped blank forming step and the ear forming step, as required, a peripheral wall thickening step may be added.

Figure 6A:
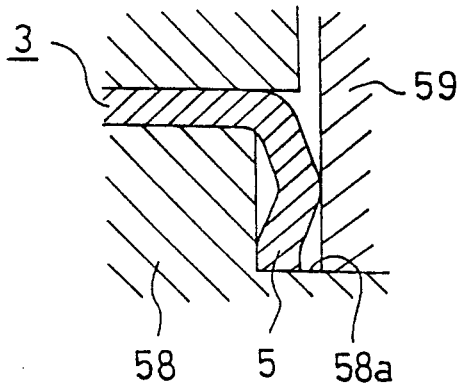
FIG. 6A and FIG. 6B are sectional views which are used to explain the thickening method of the peripheral wall of the cup-shaped blank.
Figure 6B:
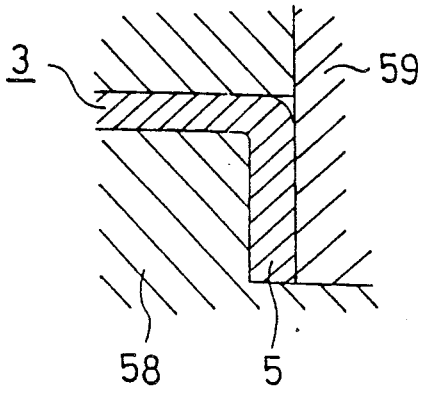

In this peripheral wall thickening step, the peripheral wall 5 of the cup-shaped blank 3 shown in FIG. 1E is bent and deformed, and the bent part is compressed from the inside and outside while being held so that the upper and lower ends of the peripheral wall 5 may not elongate in the vertical direction, thereby increasing the thickness of the peripheral wall. This step is executed by putting the cup-shaped blank 3 having the peripheral wall 5 bent and deformed in a convex shape (FIG. 1G), concave shape, corrugated shape or other various shapes over the circular inner pattern tool 58 as shown in FIG. 6A, abutting the lower end of the peripheral wall 5 of the cup-shaped blank 3 against the lower surface 58*a* of the circular inner pattern tool 58, compressing the peripheral wall 5 from the inside and the outside by the circular inner pattern tool 58 and circular outer pattern tool 59 to straighten the bend into a linear form as shown in FIG. 6B, and accordingly increasing the thickness t6 of the peripheral wall 5 (FIG. 1H).

The ear forming method for making poly-V pulleys of sheet metal, and the sheet metal made poly-V pulleys of the invention relate to an improvement of the single-layer ears, capable of shortening the axial dimension between the two ears for preventing dislocation of the poly-V belt, and in particular, in spite of the ears of such a single layer structure, the problems of strength, material cost and weight are solved, so that sheet metal made poly-V pulleys having single-layer ears are now available.

What is claimed is:

1. An ear forming method for making poly-V pulleys from sheet metal employing a circular inner pattern tool and a circular outer pattern tool having a V-shaped ear forming protrusion, comprising the steps of:

forming a cup-shaped blank of sheet metal having an integrally formed peripheral wall extending in a direction orthogonal to a bottom wall at the end part of the bottom wall; placing the cup-shaped blank over the circular inner pattern tool for supporting the inner surface of the cup-shaped blank, and for forming an annular space at least between the inner corner surface where the peripheral wall and bottom wall intersect and the corresponding surface of the circular inner pattern tool opposite to the inner corner surface;

driving, while rotating, the V-shaped ear forming protrusion into the root part of the peripheral wall corresponding to the thickness range of the bottom wall of the cup-shaped blank so as to divide a root part of the peripheral wall into two sections from its outer side, thereby forming an annular ear on the cup-shaped blank projecting outward therefrom in the radial direction for preventing dislocation of a poly-V-belt; and bulging inwardly the inner surface of the bottom wall side end part of the peripheral wall in the radial direction by pressing the peripheral wall so as to fill the annular space when forming the annular ear, thereby increasing the thickness of the bottom wall side end part of the peripheral wall.

2. An ear forming method for making poly-V pulleys from sheet metal employing a circular inner pattern tool and a circular outer pattern tool having V-shaped ear forming protrusion, comprising the steps of:

forming a cup-shaped blank of sheet metal having an integrally formed peripheral wall extending in a direction orthogonal to a bottom wall at the end part of the bottom wall; placing the cup-shaped blank over the circular inner pattern tool by which an annular space is formed at least at the confronting position between the inner surface of the circular inner pattern tool and the corner surface where the peripheral wall and the bottom wall intersect; pressing the cup-shaped blank from the outer side so as to fill the annular space and bulge the inner surface of the bottom wall side end part of the peripheral wall inward in the radial direction, thereby increasing the thickness of the bottom wall side end part of the peripheral wall; and driving, while rotating, the V-shaped ear forming protrusion into the root part of the peripheral wall corresponding to a thickness range of the bottom wall of the thickened cup-shaped blank so as to divide the root part of the peripheral wall into two sections from the outer side, thereby forming an annular ear on the cup-shaped blank projecting outward therefrom in the radial direction for preventing dislocation of a poly-V belt.

* * * * *